US005148876A

United States Patent [19]

Wilson

[11] Patent Number: 5,148,876

[45] Date of Patent: Sep. 22, 1992

[54] LIGHTWEIGHT DRILL PIPE

[75] Inventor: Gerald E. Wilson, Montgomery, Tex.

[73] Assignee: Prideco, Inc., Houston, Tex.

[21] Appl. No.: 712,529

[22] Filed: Jun. 10, 1991

[51] Int. Cl.[5] ..... E21B 17/10

[52] U.S. Cl. ..... 175/76; 175/325.3

[58] Field of Search ..... 175/320, 325, 61, 65, 175/76; 166/175, 278, 50, 387; 285/45, 286

[56] References Cited

U.S. PATENT DOCUMENTS

| | | | |
|---|---|---|---|
| 1,764,769 | 6/1930 | Woods . | |
| 1,889,866 | 12/1932 | Montgomery . | |
| 3,326,581 | 6/1967 | Wong | 285/173 |
| 3,360,846 | 1/1968 | Schellstede et al. | 29/447 |
| 3,563,323 | 2/1971 | Edgecombe | 175/76 |
| 3,784,238 | 1/1974 | Chance et al. | 285/286 |
| 4,674,580 | 6/1987 | Schuh et al. | 175/325 |
| 4,679,637 | 7/1987 | Cherrington et al. | 175/61 |
| 4,987,961 | 1/1991 | McNeely, Jr. | 175/320 |
| 5,069,297 | 12/1991 | Krueger et al. | 175/65 |

*Primary Examiner*—Ramon S. Britts
*Assistant Examiner*—Frank Tsay
*Attorney, Agent, or Firm*—Vaden, Eickenroht, Thompson, Boulware, & Feather

[57] ABSTRACT

An aluminum pipe joint is disclosed for use in a drill string for drilling wells having a well bore with a substantially non-vertical section where the portion of the drill string located in the non-vertical section is in compression and is urged into engagement with the low side of the hole by gravity. The pipe joint includes an elongated tubular member of aluminum the outer surface of which is a machined surface. The tubular member has an outside diameter equal to the outside diameter of a standard joint of drill pipe over a substantial portion of its length. A section of increased diameter is located about midway between the ends of the joint and portions of enlarged diameter are located adjacent each end of the pipe joint. The latter portions have a diameter equal to the diameter of the external upset required for tool joints. They also increase the buckling strength of the joint. Steel tool joints are attached to each end of the tube. The length of the enlarged end portions is such that the joint will not be bent during tonging if the joint is supported adjacent the end of the enlarged portion on which the tool joint being tonged is located.

6 Claims, 3 Drawing Sheets

3 1/2" STANDARD WT. STEEL DRILL PIPE TUBE (12.31 LBS/FT)
3 1/2" O.D. x 2 1/4" I.D. ALUMINUM DRILL PIPE TUBE (6.77 LBS/FT)
LENGTH OF TUBE (FEET)
WEIGHT TO BUCKLE (LBS x 1000)
45
40
35
30
25
20
15
10
5
0
0
20
40
60
80
100
120
140
160
180
200
220
240
18,600
41,000
74,300
164,000

LIGHTWEIGHT DRILL PIPE

This invention relates to lightweight drill pipe for use in a drill string for drilling wells having a well bore with a substantially non-vertical section where the portion of the drill string located in the non-vertical section is in compression and is urged into engagement with the low side of the hole by gravity.

It is common practice today with respect to certain producing formations to drill a well bore vertically to about the top of the producing formation, kick the well bore off vertical about 90°, and drill horizontally as far as possible in the producing formation. The reason for this, of course, is to increase drainage of the reservoir into the well bore and increase production from the well. One area where this is commonly done these days is in the Austin chalk formation in Texas. The oil in this formation is found in fractures. The farther the well bore extends into the formation, the greater the chance of penetrating multiple fractures.

Another application of high angle drilling is for extended reach wells. This technique makes it possible to drill and produce two or more reservoirs from the same platform or location. If these high angle holes can be drilled successfully the distance necessary to penetrate another reservoir, it can save the cost of building other expensive platforms nearby the existing one.

When drilling the horizontal sections or near horizontal sections of these well bores, the bit will drill ahead only as long as it is forced against the formation with substantial force. When drilling vertical well bores, thick walled pipe joints, called drill collars, are located just above the drill bit and supply the desired force on the bit by their weight alone. Therefore, any force urging the bit against the formation must come from the weight of the drill string located in the non-horizontal portions of the well bore. As the angle of the well bore changes from vertical to horizontal, the drill string in the non-vertical section of the well bore is urged against the low side of the well bore by gravity. Under these conditions, the portion of the drill string in the kickoff and horizontal portions of the well bore can exert very little, if any, weight on the bit because most of its weight is exerted against the low side of the well bore. The force exerted on the drill bit by the weight of the non-horizontal portion of the drill string, however, is reduced by the friction between the pipe string and the low side of the well bore.

To reduce the friction between the drill pipe and the wall of the well bore in the curved and horizontal sections of the well bore, it is common practice these days to use conventional drill pipe in this section of the well bore and locate the drill collars that provide the weight to be transmitted to the bit in the vertical or near vertical sections of the well bore. With this arrangement, since the pipe in the curved and horizontal sections is in compression, the limiting factor now becomes the buckling strength of the drill pipe. Usually, a joint of drill pipe is about 30 ft. long. The force required to buckle a 30 ft. joint of 3½" 13.30 lbs. per foot steel drill pipe is about 41,000 lbs. Therefore, if it is desired to have 10,000 lbs. of force at the bit urging the bit to drill, there will be a little over 30,000 lbs. of force available to overcome the frictional force between the drill pipe and the well bore when the force exerted on the drill pipe is at or close to its buckling force.

This problem was partially overcome by Schuh et al as disclosed in U.S. Pat. No. 4,674,580, which issued Jan. 23, 1987. Since the buckling load for a joint of drill pipe is calculated as if each joint acts as a column in compression, then Euler's Formula can be used to determine the buckling load for the drill pipe. Schuh et al suggest that cylindrical stress sleeves be located on the pipe joint between the tool joints to in effect divide the pipe joint into a plurality of shorter individual columns rather than one 30 ft. column. Thus, each cylindrical stress sleeve acts as a tool joint to effectively shorten the length of the joints and increase their resistance to buckling. Specifically Schuh et al stated in column 5, beginning at line 5 et seq.

> In accordance with the present invention, a length of standard pipe becomes a plurality of shorter lengths due to the spacing of sleeves 30 on pipe body 13. This gives the same effect as if the plurality of shorter lengths were joined together by tool joints which, itself, is impractical due to economic considerations.

Schuh et al are talking about steel drill pipe. They did not recognize that by using aluminum drill pipe with stress sleeves in the middle and steel tool joints, a satisfactory buckling resistant drill string is available and one that is substantially lighter. Being lighter, there is less friction so the string is able to transmit the required weight on the bit for a greater distance than the steel pipe and thus is able to drill longer horizontal well bores.

Further, Schuh et al were talking about the cost of adding three additional tool joints per 30 ft. joint. This is unnecessary. Locating a stress sleeve in the middle of a 30 ft. joint of aluminum drill pipe provides ample rigidity (resistance to buckling) and by reducing the normal force between the pipe string and the low side of the well bore, the force required to overcome the friction between the pipe and the well bore is reduced substantially.

Therefore it is an object of this invention to provide an aluminum pipe joint for use in drilling highly inclined and horizontal well bores. It is a further object to provide a pipe joint about 30 ft. long having an aluminum tube section, steel tool joints attached to each end of the tube, and a stress sleeve located in the middle with an outside diameter equal to that of the tool joints so that the force required to buckle such aluminum pipe joints is at least equal to that of a 30 ft. joint of steel drill pipe of the same diameter.

It is a further object of this invention to provide such a pipe joint that includes a machined aluminum tube having portions of enlarged diameter adjacent the ends of the tube to increase the bending moment of the tube adjacent each end, said portions ending close enough to the top of the tool joint to avoid bending the pipe during tonging, i.e., making up and breaking out a joint, while supported by rotary slips.

It is a further object of this invention to provide such a lightweight joint of drill pipe wherein the aluminum tube section is machined from stock to provide an integral section of enlarged diameter midway between the ends of the tube to which can be attached a stress sleeve that can rotate relative to the tube and portions adjacent the ends of the tube of a diameter equal to the upset diameter required for the tool joints.

These and other objects, advantages, and features of this invention will be apparent to those skilled in the art from a consideration of this specification, including the attached drawings and appended claims.

Figure 1:
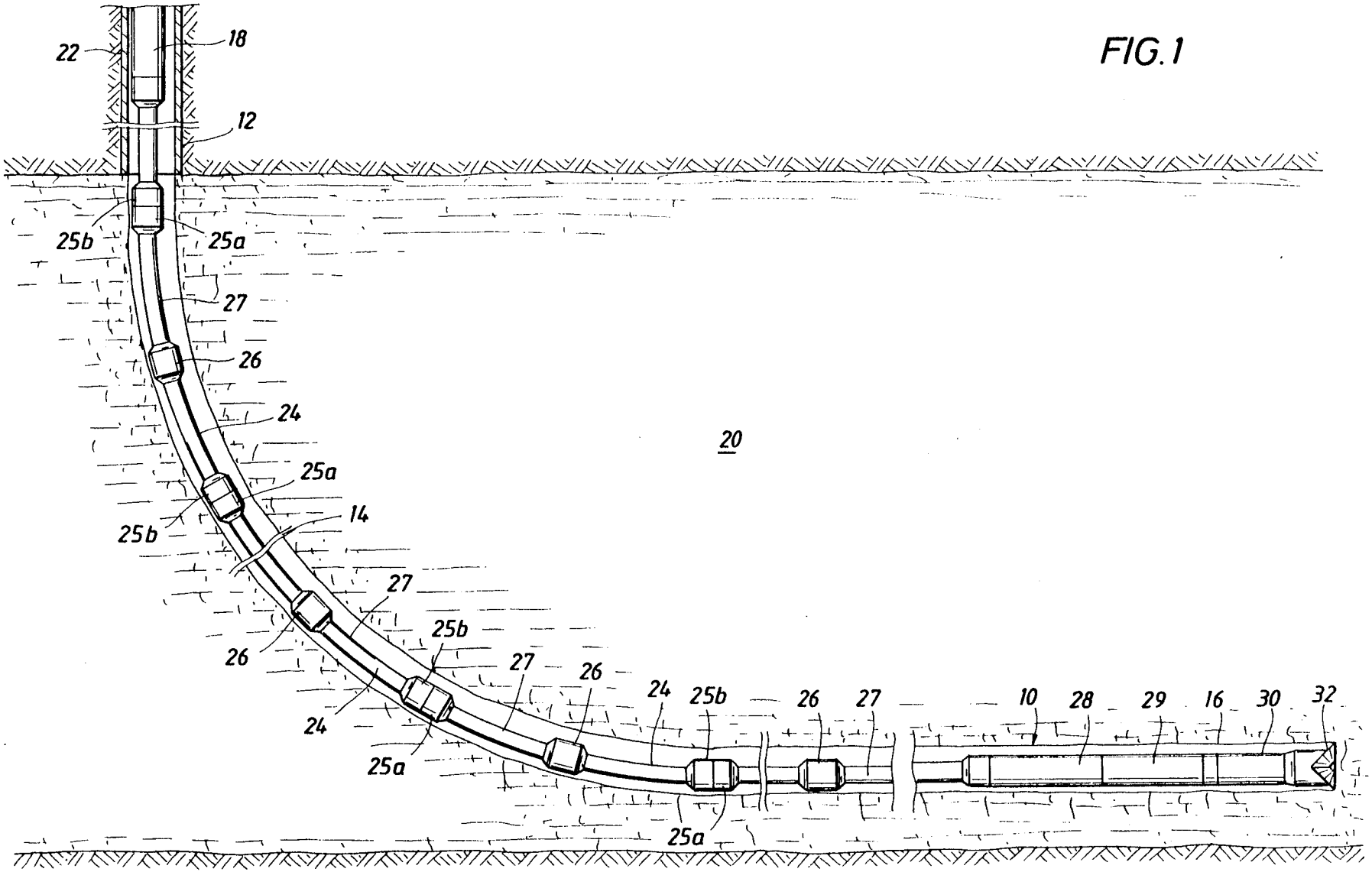
FIG. 1 is a schematic cross-section of the lower portion of a pipe string located in a well bore having a vertical portion, a curved kick-off portion, and a horizontal portion.

In accordance with this invention, a lightweight drill pipe joint and stress sleeve are disclosed for use in drilling wells having a well bore with a substantial non-vertical section where the portion of the drill string located in the non-vertical section is in compression and is urged into engagement with the low side of the well bore by gravity. An example of such a well is shown in FIG. 1 where well bore 10 includes a generally vertical first portion 12, a curved kick-off portion 14, and a generally horizontal third portion 16. Often after drilling to the top of the producing formation 20, casing is set as shown in FIG. 1, where casing 22 is shown extending to the top of producing formation 20 where it is cemented in the well bore.

After the casing is set, kick-off portion 14 of the well bore is drilled using conventional methods until the well bore is headed in a generally horizontal direction. Depending upon the angle the formation makes with the horizontal, it may be desirable that this portion of the well bore follow the direction of the formation, which may or may not require this section of the well bore to be horizontal. It could be several degrees off in either direction. Sometimes, the well is kicked off above the producing zone and casing is then set through a portion of the radius into the producing zone. Then the radius is finished and the horizontal section is drilled.

At the time that the horizontal portion of the well bore is being drilled, as explained above, the drill string is made up of drill collars 18 located in vertical section 12 of well bore 10. Below that, the drill string is made up of the pipe joints of this invention, indicated by the number 24. Each joint includes tool joint box 25*a* on the upper end and tool joint pin 25*b* on the lower end. Stress sleeve 26 is located on aluminum tube 27 about midway between the tool joints. At the lower end of the drill string is M.W.D. (measurement while drilling) tool 28, non-magnetic drill collar 29, downhole motor 30, and drill bit 32. The use of a downhole motor and M.W.D. tool is optional. There are advantages to their use, however. The downhole motor eliminates the need to rotate the drill pipe. With a bent sub and the M.W.D. tool, the direction of the hole can be changed without making a trip.

Figure 3:
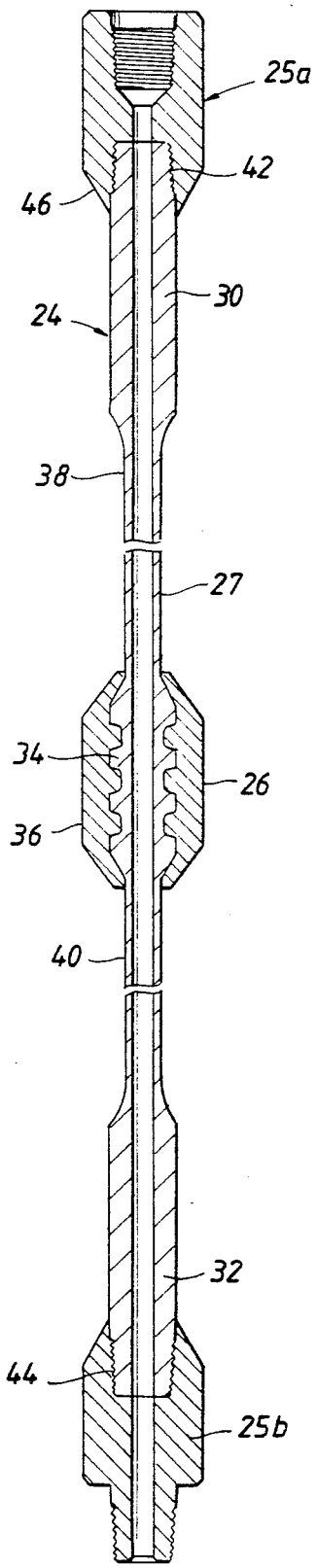
FIG. 3 is a sectional view of the aluminum drill pipe joint of this invention.

The pipe joint of this invention is shown in section in FIG. 3. Aluminum tube section 27 of the joint is machined from aluminum tubing to the configuration shown in FIG. 3. The tube includes portions 30 and 32 of enlarged diameter located at opposite ends of the tube. In the middle of the joint is section 34 also of enlarged diameter upon which is mounted stress sleeve 36. The rest of the tube, portions 38 and 40, are machined to have an outside diameter equal to a standard joint of drill pipe, such as 3½" or 4½". End portions 30 and 32 are machined to have an outside diameter equal to what the ends of the tube would be if they were upset in order to have tool joints 25*a* and 25*b* attached to them. In the embodiment shown, the tool joints are shrink fitted onto threads 42 and 44 that are machined on the end of the tube. Each tool joint has an 18° tapered surface 46 for engaging conventional elevators. Portion 30 of enlarged diameter that is attached to tool joint box 25*a* extends downwardly a distance to add weight and stiffness to the joint but stops short of the maximum distance that can be tolerated to prevent the pipe from being bent while being tonged to make up or breakout the connection between box 25*a* and the pin of another joint above it in the string. This distance can be calculated from the formula $$H\max = \frac{C(Ym)(I/C)(L\tau)}{T}$$

where C is a constant depending upon the angle of separation between the makeup and breakup tongs, where the tongs are at 90° the constant is 0.053, where the tongs are 180° apart the constant is equal to 0.038. Ym equals minimum tensile yield stress of pipe in psi, Lr=tong arm length in feet, P=line pull (load) in lbs., T=makeup torque applied to tool joint in lb. feet (P×Lτ), I/C=section modulus of pipe in in.$^3$.

For 3½" aluminum drill pipe with steel tool joints, Hmax for 90°=3.5 ft., Hmax for 180°=2.70 ft. or 32.44". Thus, the length of section 30 combined with the length of the tool joint should not exceed 32" and probably should be somewhat less to allow the slips to engage the pipe a short distance below the end of section 30.

The lower end of tube 24 is machined in the same manner to the same dimensions. This provides the upset diameter required for shrink fitting tool joint pin 25*b* on the end of the pipe. It also allows the pipe to be run with pin up and, of course, adds considerable stiffness to the pipe adjacent the ends by increasing the section modulus of the pipe adjacent its ends.

Figure 2:
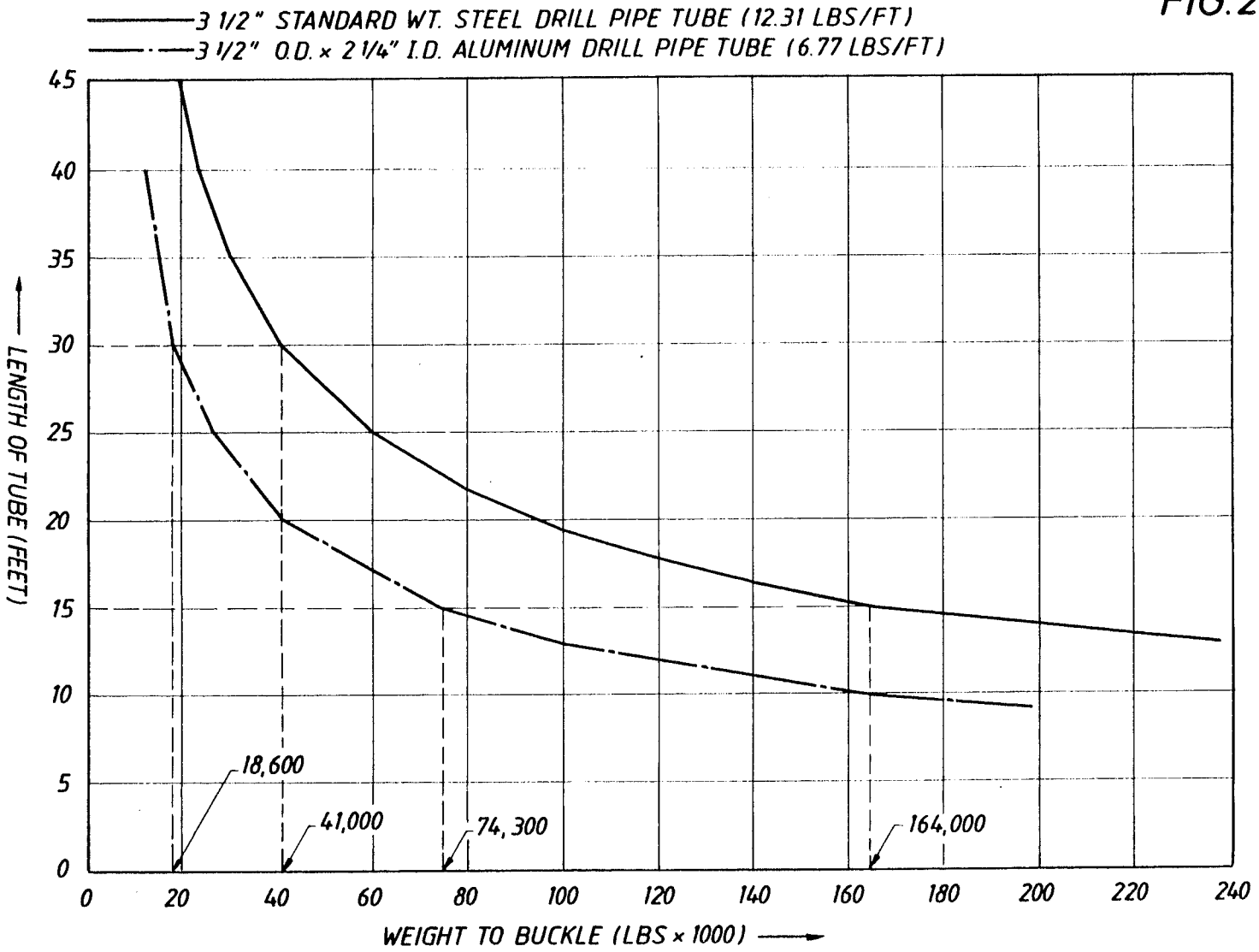
FIG. 2 is a graph showing the weight required to buckle various lengths of 3½" O.D. standard weight (12.31 lbs./ft.) steel drill pipe tubes and 3½" O.D. ×2¼" I.D. (6.77 lbs./ft.) aluminum drill pipe tubes.

In that regard, as shown in FIG. 2, the weight required to buckle a 3½" O.D.×2¼" I.D. aluminum drill pipe tube is 18,600 lbs. By adding wear sleeve 36, which has a diameter approximately equal that of the tool joints, the joint is effectively converted to two 15 ft. lengths of drill pipe and the weight required to buckle the joint increases to 74,300 lbs. This exceeds substantially the buckling strength of a 30 ft. joint of steel drill pipe since it will buckle at 41,000 lbs. As a result, the aluminum tube of the pipe joint of this invention provides a greater resistance to buckling than a steel tube while reducing the weight of the joints substantially.

Figure 4:
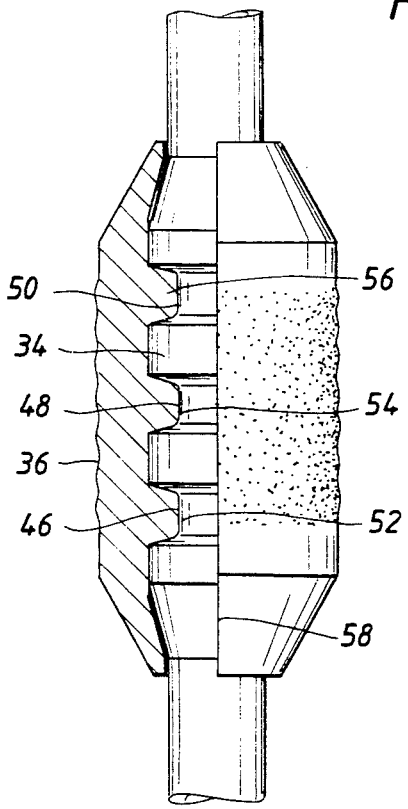
FIG. 4 is a view, partly in section and partly in elevation of a stress sleeve attached to the pipe joint of FIG. 3.

FIG. 4 is a view on an enlarged scale, partially in section and partially in elevation, of the mid section of the joint showing wear or stress sleeve 36 attached to upset portion 34 of the aluminum tube. As shown, the outer surface of portion 34 has three spaced grooves 46, 48, and 50. Stress sleeve 36 has internal flanges 52, 54, and 56 that engage the grooves and lock the stress sleeve against longitudinal movement relative to the tube.

The sleeve is assembled onto the tube by cutting the sleeve into two pieces along line 58, then fitting the two pieces together in position so that the flanges engage the grooves and welding the two pieces back together. In this embodiment of the stress sleeve, preferably an epoxy is injected in the space between the stress sleeve and the tube to seal the space from drilling fluid and to anchor the sleeve to the tube so that it rotates with the tube.

Figure 5:
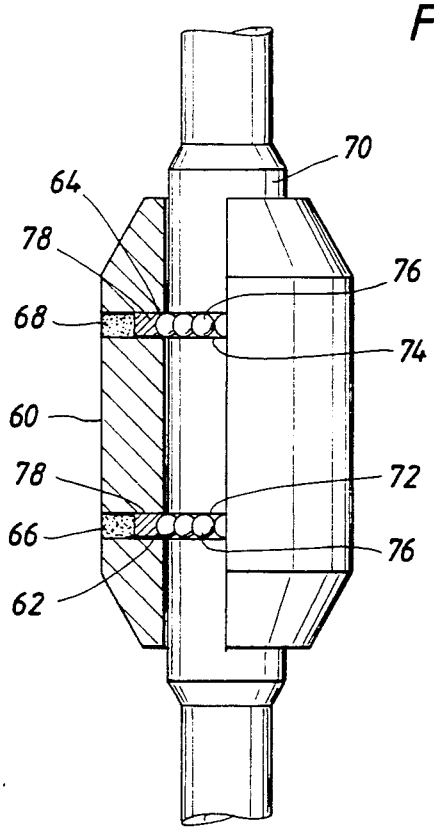
FIG. 5 is an alternate stress sleeve mounted on the pipe joint for relative rotation between the pipe joint and the stress sleeve.

In FIG. 5, an alternate embodiment of the stress sleeve is shown. In this case, the sleeve can rotate relative to the tube. In other words, it is a non-rotating sleeve when it is in engagement with the side of the well bore. Sleeve 60 has internal semi-circular grooves 62 and 64 that are connected to the outer surface of the sleeve by holes 66 and 68. Section 70 that is machined on the outer surface of the tube of the joint has annular grooves 72 and 74 that are in alignment with grooves 62 and 64 in the sleeve. The two semi-circular grooves are then filled with balls 76 through openings 66 and 68. When the grooves are filled with balls, holes 66 and 68 are closed by plugs 78 and the sleeve is securely mounted on the outside of upset 70 to freely rotate relative to the upset, when the outer sleeve is held against rotation by the friction between the sleeve and the wall of the well bore.

From the foregoing it will be seen that this invention is one well adapted to attain all of the ends and objects hereinabove set forth, together with other advantages that are obvious and inherent in the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. An aluminum pipe joint for use in a drill string for drilling wells having a well bore with a substantially non-vertical section where the portion of the drill string located in the non-vertical section is in compression and is urged into engagement with the low side of the hole by gravity, comprising an elongated tubular member of aluminum the outer surface of which is a machined surface, said tubular member having an outside diameter equal to the outside diameter of a standard joint of drill pipe over a substantial portion of its length, a section of increased diameter about midway between the ends of the joint, portions of enlarged diameter adjacent each end of the pipe joint having a diameter equal to the diameter of the external upset required for tool joints and to increase the buckling strength of the joint, steel tool joints attached to each end of the tube, the length of said enlarged end portions being such that the joint will not be bent during tonging if the joint is supported adjacent the end of the enlarged portion on which the tool joint being tonged is located.

2. The pipe joint of claim 1 further provided with a stress sleeve mounted on the section of enlarged diameter that is located midway between the ends of the joint, said sleeve having an outside diameter equal to the outside diameter of the tool joint, and means engaging the joint and the sleeve for holding the sleeve from moving longitudinally relative to the enlarged diameter section while allowing the sleeve to remain stationary in engagement with the wall of a well bore while the pipe joint rotates relative to the sleeve.

3. The pipe joint of claim 1 further provided with a stress sleeve mounted for rotation relative to the pipe joint on the section of enlarged diameter midway between the ends of the joint, said stress sleeve comprising a sleeve split longitudinally into two halves for fitting over the sections of enlarged diameter, means connecting the two halves over the section, opposing grooves in the outer surface of the enlarged section and the inner surface of the sleeve, openings extending from the outer surface of the sleeve to the grooves in the inner surface, and a plurality of balls filling the opposing grooves to hold the sleeves from moving longitudinally of the section, said balls having been positioned in the grooves through the openings.

4. The pipe joint of claim 2 in which the holding means includes at least one annular groove on the enlarged section and an annular ring on the inside of the sleeve in engagement with the groove.

5. An aluminum pipe joint for use in a drill string for drilling wells having a well bore with a substantially non-vertical section where the portion of the pipe string located in the non-vertical section is in compression and is urged into engagement with the low side of the hole by gravity, comprising an elongated tubular member of aluminum, said tubular member having an outside diameter equal to the outside diameter of a standard joint of drill pipe, steel tool joints attached to each end of the tube, and a stress sleeve mounted on the elongated tubular member for rotation relative to the tubular member and having a diameter about the same as the diameter of the tool joints to reduce the torque required to rotate the pipe joint and increase the buckling strength of the pipe joint.

6. The pipe joint of claim 5 in which the stress sleeve includes a sleeve split longitudinally into two halves for fitting over the section of enlarged diameter, means connecting the two halves over the section, opposing grooves in the outer surface of the enlarged section and the inner surface of the sleeve, openings extending from the outer surface of the sleeve to the grooves in the inner surface, and a plurality of balls filling the opposing grooves to hold the sleeves from moving longitudinally of the section, said balls having been positioned in the grooves through the openings.

* * * * *